US008075636B2

(12) United States Patent
Bringewatt

(10) Patent No.: US 8,075,636 B2
(45) Date of Patent: Dec. 13, 2011

(54) METHOD AND DEVICE FOR THE WET TREATMENT OF ITEMS TO BE WASHED

(75) Inventor: Wilhelm Bringewatt, Porta Westfalica (DE)

(73) Assignee: Herbert Kannegiesser GmbH, Vlotho (DE)

( * ) Notice: Subject to any disclaimer, the term of this patent is extended or adjusted under 35 U.S.C. 154(b) by 875 days.

(21) Appl. No.: 11/815,717

(22) PCT Filed: Jan. 19, 2006

(86) PCT No.: PCT/EP2006/000433

§ 371 (c)(1), (2), (4) Date: May 21, 2008

(87) PCT Pub. No.: WO2006/084550

PCT Pub. Date: Aug. 17, 2006

(65) Prior Publication Data

US 2010/0146711 A1 Jun. 17, 2010

(30) Foreign Application Priority Data

Feb. 11, 2005 (DE) ..... 10 2005 006 559
Aug. 12, 2005 (DE) ..... 10 2005 038 142
Nov. 4, 2005 (DE) ..... 10 2005 053 086

(51) Int. Cl.
*D06F 47/00* (2006.01)

(52) U.S. Cl. ..... 8/137; 134/42

(58) Field of Classification Search ..... 8/137; 134/42
See application file for complete search history.

(56) References Cited

U.S. PATENT DOCUMENTS 2,823,602 A * 2/1958 Zimarik et al. ..... 100/35
4,118,958 A * 10/1978 Lemon et al. ..... 68/22 R
4,676,079 A * 6/1987 Czauderna ..... 68/242
2002/0116770 A1 8/2002 Mehrmann

FOREIGN PATENT DOCUMENTS

DE 30 40 449 A1 5/1982
EP 1 076 127 2/2001
JP 52-154266 12/1977
JP 60-242895 12/1985

* cited by examiner

*Primary Examiner* — Amina Khan
(74) *Attorney, Agent, or Firm* — Laurence P. Colton; Smith Risley Tempel Santos LLC

(57) ABSTRACT

An inline washing system to be formed from a tunnel-type washing machine (10) which only washes the items of laundry is described. Rinsing and also water removal are then performed in the downstream water-removal press (18). It has been found that the rinsing performance is better and fresh water can be saved as a result of this. It is therefore also possible to wash relatively small amounts of laundry using a tunnel-type washing machine (10) in an economical manner because the tunnel-type washing machine (10) can be designed without a rinse zone.

27 Claims, 1 Drawing Sheet

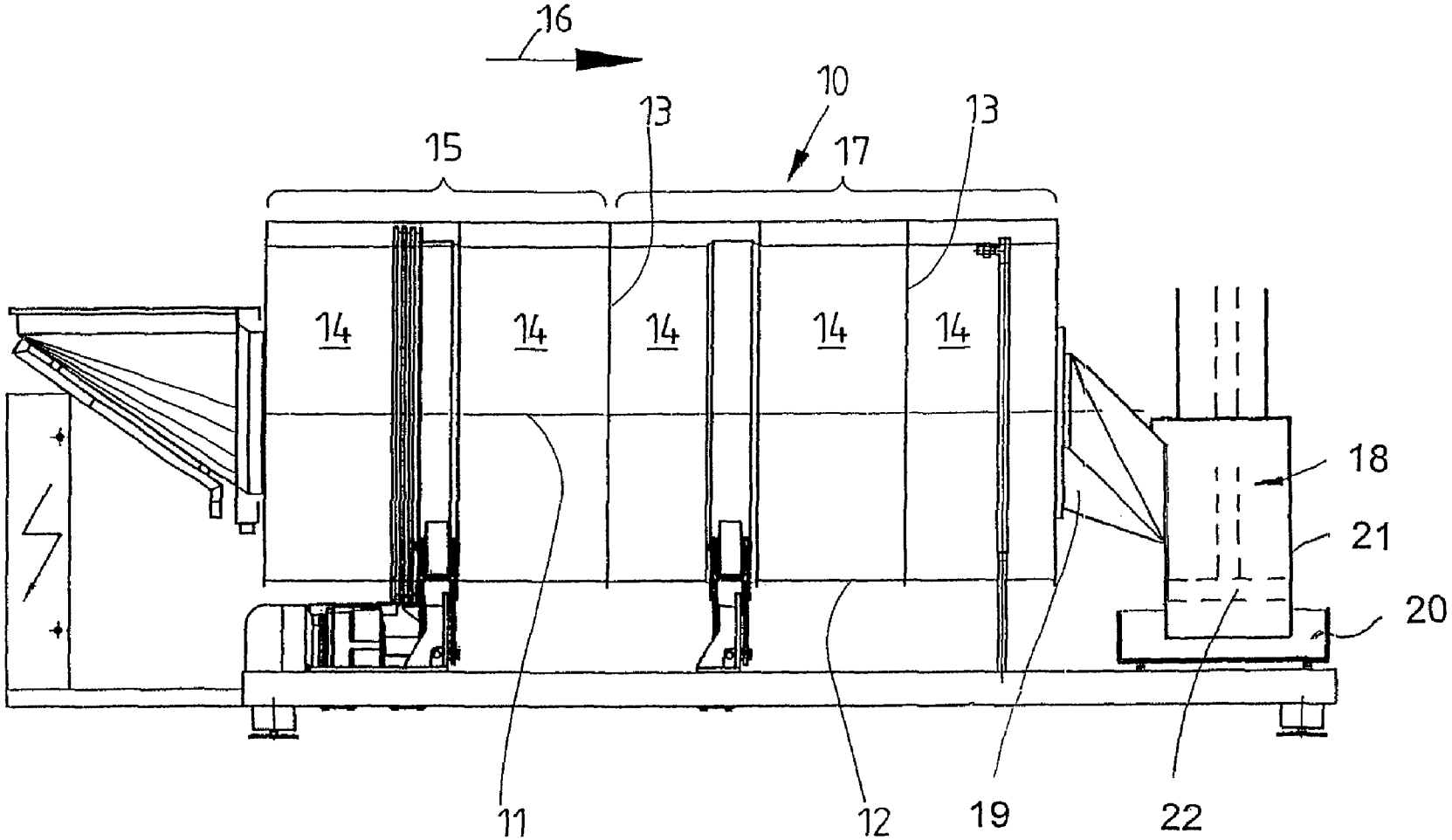
10
11
12
13
13
14
14
14
14
14
15
16
17
18
19
20
21
22

METHOD AND DEVICE FOR THE WET TREATMENT OF ITEMS TO BE WASHED

STATEMENT OF RELATED APPLICATION

This application is the U.S. National Phase under Chapter II of the Patent Cooperation Treaty (PCT) of PCT International Application No. PCT/EP2006/000433 having an International Filing Date of 19 Jan. 2006.

1. TECHNICAL FIELD

The invention relates to a method for the wet-treatment of items of laundry in which the items of laundry are washed in a washing device and water is at least removed in at least one downstream water-removal device, and to an apparatus for the wet-treatment of items of laundry.

2. RELATED ART

Liquids are used for the wet-treatment of laundry, in particular for washing and rinsing items of laundry, with said liquids substantially being fresh water in the case of rinsing. The rinse result is also dependent on the quantity of fresh water used. However, for environmental reasons, it is desirable to reduce the fresh-water requirement as far as possible.

So-called tunnel-type washing machines comprising an elongate drum which can be driven in rotation and in which successive chambers are formed have proven advantageous for washing and rinsing items of laundry. In known tunnel-type washing machines, at least three zones, namely a pre-wash zone, and main-wash zone and a rinse zone, are arranged in series. A counter-current of free liquor is required in the rinse zone, and for this reason additional outer chambers have to be associated with the drum. As a result, the known tunnel-type washing machines have a relatively complicated structure, and so tunnel-type washing machines are used only where large amounts of laundry are to be washed. On account of the at least three successive zones, the drum has to have a relatively long length, as a result of which the known tunnel-type washing machines take up a great deal of space in the laundry facility.

BRIEF SUMMARY OF THE INVENTION

The object of the invention is to provide a method and an apparatus for the wet-treatment of items of laundry in an economical manner. The method and the apparatus should preferably also permit economical wet-treatment of relatively small batches of laundry.

One method for achieving this object is a method for the wet-treatment of items of laundry in which the items of laundry are washed in a washing device and water is at least removed in at least one downstream water-removal device, comprising the steps of both (a) rinsing the items of laundry and (b) removing water from the items of laundry in the at least one water-removal device, wherein the water-removal device is a water-removal press. Since the respective water-removal device is in the form of a water-removal press and not only removes water from the laundry but also rinses the laundry in the respective water-removal press, the rinsing process can be transferred from the washing device to the water-removal device. As a result, the rinse zone can be omitted from the washing device, as a result of which the washing device can be of simpler construction, in particular takes up less space. Above all, the washing device no longer has to be designed to generate a counter-current of the treatment liquid.

Since the respective water-removal press is required in any case, the method according to the invention provides a space-saving inline washing system overall. In addition, it has surprisingly been found that the laundry can be rinsed in water-removal presses far more effectively than in the washing device. In this way, the rinsing performance is improved and fresh water is saved.

Provision is also made for the laundry to be transferred from the washing device to the at least one water-removal press with only the bound liquor or only some of said bound liquor from the main washing operation. As a result, only the free liquor needs to be separated from the laundry in the washing device.

According to one preferred refinement of the method according to the invention, at least some of the bound liquor is removed from the laundry in the water-removal press, before the laundry is actually rinsed in the water-removal press. During this initial removal of some of the bound to occur from the items of laundry, initial rinsing may be performed at the same time. The bound liquor can be separated from the laundry in the water-removal press in a very simple and primarily more effective manner than in the washing device. As a result, more effective rinsing can be performed, and this not only shortens the rinse cycle but primarily also contributes to a saving of fresh water because less fresh water is required for effective rinsing if at least a large part of the bound liquor has already been separated from the laundry.

According to the invention, the items of laundry are rinsed in the respective water-removal press by a plurality of successive pressing processes. A pressing pressure which serves as the pressing pressure for removing water from the items of laundry, that is to say to separate a large part of the bound liquor from the items of laundry, is preferably exerted only during the last pressing process. The items of laundry are protected during rinsing in the respective water-removal press because the preceding pressing processes are performed at a lower pressing pressure.

Provision is also made for the items of laundry to be transferred directly from the washing device to one or more water-removal presses. If the cycle time of the washing device corresponds approximately to that of the water-removal press, a single water-removal press is sufficient. In cases where, on account of the rinse phase which is also performed in the water-removal press according to the invention, the residence time of the items of laundry in the water-removal press is longer than in the washing device, provision is made to use a plurality of water-removal presses which are alternately loaded with items of laundry from the washing device.

As an alternative, it is also feasible to temporarily store the laundry before transferring it to the water-removal press. Different cycle times between the washing device and the water-removal press can be compensated as a result of this too, with it then possibly being sufficient for only one single water-removal press to be associated with the washing device, with the washed items of laundry being temporarily stored until a water-removal press is available in the event of misaligned cycles between the washing device and the water-removal press. As a result, the washing device can be operated completely independently of the water-removal press. A plurality of temporary storage means can be provided if necessary.

Furthermore, the method according to the invention makes provision for the washing device used to be a tunnel-type washing machine which serves only for washing but not for rinsing the laundry. The tunnel-type washing machine preferably has an elongate drum which can be driven in rotation and in which successive chambers are formed, with one or more chambers forming a prewash zone and a main-wash zone. Tunnel-type washing machines of this type of proven advantageous in practice. To date, they have been extremely long on account of possessing a plurality of successive zones. Since rinsing no longer takes place in the tunnel-type washing machine according to the invention, said tunnel-type washing machine does not require any additional rinse zones with outer chambers for generating a counter-current, as a result of which the tunnel-type washing machine is shorter and also has a simpler structure. A simplified tunnel-type washing machine of this kind with only one prewash zone and one main-wash zone can also be used in an economical manner for the wet-treatment of relatively small batches of laundry.

In one preferred refinement of the method, provision is made for the items of laundry to be initially prepressed in the respective water-removal press. In the process, the items of laundry are freed from some of the liquor bound therein. If some of the bound liquor has already been separated off in the tunnel-type washing machine before the items of laundry are transferred to the water-removal press, more of the bound liquor is removed during prepressing of the items of laundry in the water-removal press. Before the laundry is rinsed, it is freed from some, preferably at least one third, of the bound liquor in this way. The items of laundry are prepressed at a pressure of between 3 and 10 bar, preferably approximately 4 to 6 bar. In this way, a large part of the bound liquor is removed from the items of laundry and also a type of laundry cake through which liquid can be pressed only under pressure, is formed during the pre-compression.

The method also makes provision for the items of laundry or the laundry cake and to be wetted with liquid again at least one more time after the prepressing. At least the last wetting operation is preferably performed with fresh water. Re-wetting of the items of laundry contributes to the rinsing itself. Rewetting of the items of laundry at least once is performed after pre-compression and subsequent lifting-off of the press piston of the water-removal press from the items of laundry or the laundry cake. In this way, space is created between the upper face of the items of laundry or the laundry cake and the lower face of the press piston in order to be able to supply the liquid, which is used for rewetting, to the items of laundry.

According to one preferred development of the method, provision is made to press liquid at least once, preferably a number of times in succession, through the items of laundry or the laundry cake. Pressing liquid through the items of laundry of the laundry cake under pressure leads to effective rinsing of the items of laundry.

Rewetting of the items of laundry and the subsequent pressing of the liquid through the items of laundry under pressure is performed after liquid has been supplied to the items of laundry following pre-compression and raising of the press piston. The liquid can always be fresh water. However, it is also sufficient for fresh water to be used for a final re-wetting operation or in a few concluding rewetting processes. Pressing liquid which is produced during prepressing can be used in the first re-wetting operation, said pressing liquid having been captured in a collection tank which is associated with the water-removal press. In this case, the bound liquor is pressed through the items of laundry a number of times in circulation for initial rinsing of said items of laundry.

The items of laundry are preferably rewetted in such a way that so much liquid is applied to the laundry cake which is formed during prepressing that a closed liquid layer, in particular a liquid column, with a specific height is formed on the laundry cake. This liquid cannot infiltrate the laundry cake to a significant extent without an external pressure force produced by the press plunger, in particular cannot flow through the laundry cake. A closed liquid layer with a specific level is therefore produced on the laundry cake. The liquid is also prevented from flowing off by a liquid-impermeable circumferential press housing in which the laundry cake together with the liquid layer applied to it is located. The liquid of the liquid layer is then subjected to the action of force by the press plunger being lowered and in the process said liquid is forced through the items of laundry in the laundry cake under pressure. Forcing liquid through items of laundry under pressure in this way leads to effective rinsing of said items of laundry, with the liquid being removed from the items of laundry by the press plunger at the end of the rinsing process to such an extent that said items of laundry contain hardly any bound liquor, as is the case when water is removed from items of laundry in the conventional manner in a laundry press.

An apparatus for achieving the object mentioned in the introduction is an apparatus for the wet-treatment of items of laundry, comprising a tunnel-type washing machine and at least water-removal device, wherein the tunnel-type washing machine has only one prewash zone and a main-wash zone, and the at least one water-removal device is a water-removal press. Accordingly, provision is made for the tunnel-type washing machine to have only one prewash zone and one main-wash zone. Accordingly, said tunnel-type washing machine does not contain the rinse zone which is customary in known tunnel-type washing machines. As a result, the tunnel-type washing machine of the apparatus can be of simpler construction. In particular, the tunnel-type washing machine is shortened on account of the rinse zone being omitted and therefore takes up only a relatively small amount of space. Furthermore, provision is made for the water-removal device used to be at least one water-removal press which does not need to be substantially modified and leads to effective rinsing of the items of laundry with little fresh-water input.

In one alternative refinement of the apparatus it is feasible to arrange a plurality of water-removal presses downstream of a single tunnel-type washing machine. It is then possible for the cycle time in the tunnel-type washing machine to be shorter than in the respective water-removal press since one of the plurality of water-removal presses alternately receives the batch of laundry from the tunnel-type washing machine. As a result, final treatment of the items of laundry can be performed in cycles in an overlapping manner in the water-removal presses in the event of offset treatment cycles of the items of laundry in the water-removal presses.

In another alternative refinement of the apparatus, provision is made for at least one laundry storage means to be arranged between the tunnel-type washing machine and at least one of these downstream water-removal presses. A single water-removal press may then be sufficient if the cycle time for treating the laundry in the water-removal press is somewhat greater than in the tunnel-type washing machine since the laundry, which cannot be immediately finally treated, is initially buffer-stored in at least one laundry storage means until the water-removal press is available. As a result, operation of the tunnel-type washing machine can be decoupled from the water-removal press.

BRIEF DESCRIPTION OF THE DRAWING

One preferred exemplary embodiment of the invention is explained in greater detail below with reference to the drawing. The single FIGURE of the drawing shows a side view of the apparatus comprising a tunnel-type washing machine and a water-removal press.

DETAILED DESCRIPTION OF PREFERRED EMBODIMENTS

The apparatus shown here represents an inline washing system for the wet-treatment of items of laundry, in particular for washing, rinsing and removing water from said items of laundry. The apparatuses have a simplified tunnel-type washing machine 10, as a result of which said tunnel-type washing machine is, in contrast to conventional tunnel-type washing machines, also suitable for washing relatively small amounts of laundry starting from 150 kg/h.

The tunnel-type washing machine 10 has a drum 12 which can be driven in rotation about a preferably horizontal axis of rotation 11. A plurality of chambers 14 which follow one another in the passage direction 16 of the items of laundry (not shown) through the drum 12 are formed in the drum 12 by transversely direction partition walls 13. An outer drum which is associated with at least a part of the drum 12 it is not required by the tunnel-type washing machine 10 on account of the invention, for which reason a tunnel-type washing machine 10 without an outer drum is used in the invention.

The drum 12 of the tunnel-type washing machine 10 contains essentially only two treatment zones, specifically a prewash zone 15 and a main-wash zone 17 which follows the prewash zone 15 in the passage direction 16 of the items of laundry through the drum 12. In the exemplary embodiment shown, five chambers 14 which follow one another in the passage direction 16 are formed in the drum 12 of the tunnel-type washing machine 10. In this case, two chambers 14 serve to form the prewash zone 15, while three chambers 14 form the main-wash zone 17. However, the invention is not restricted to tunnel-type washing machines 10 with five successive chambers 14. Instead, the number of chambers 14 may differ from the exemplary important shown. It may be sufficient for the tunnel-type washing machine 10 to have only one single chamber 14 for forming the prewash zone 15 and one single chamber 14 for forming the main-wash zone 17. However, the number of chambers 14 in the main-washed zone 17 is generally higher than the number of chambers 14 in the prewash zone 15 by one chamber 14.

In the apparatus shown, a single water-removal device is arranged downstream of the tunnel-type washing machine 10, said water-removal device being a water-removal press 18. The items of laundry pass from the tunnel-type washing machine 10 to the water-removal press 18 via a discharging chute 19 which is arranged at the end of said tunnel-type washing machine. The water-removal press 18 is designed in a manner which is known in principle. Accordingly, the water-removal press 18 has a press housing which is open at the top and bottom, preferably a cylindrical press basket 21 with a liquid-impermeable casing surface and a press plunger 22 which can be moved upward and downward and is only outlined (in dashed lines) in the FIGURE. The press plunger 22 can be raised by a hydraulic cylinder to such an extent that it is located above the press basket 21, in particular for the purpose of charging the water-removal press 18, and as a result completely frees the upper opening in the press basket 21. In order to remove water from and rinse the items of laundry, the press plunger 22 can be inserted into the press basket 21, with the press plunger 22 being sealed off in a substantially liquid-tight manner inside the casing surface of the press basket 21. A collection tank 20 for liquid, specifically the bound liquor which in the case of invention is also rinsing liquid, which is pressed for out of the items of laundry in the water-removal press 18, is located beneath the press basket 21.

In order to carry out the method according to the invention, the water-removal press 18 is provided with at least one liquid supply means. This liquid supply means opens either in the upper edge region of the press basket 21 or the liquid which is a liquid which is suitable for rinsing purposes, for example fresh-water, is supplied to the press basket 21 through the free opening in the upper face.

At the outlet end of the tunnel-type washing machine 10, a plurality of water-removal presses 18 can be arranged differently from the exemplary embodiment shown, it being possible to use said water-removal presses to alternately rinse and remove water from the items of laundry. To this end, provision is preferably made for the water-removal presses 18 to be arranged in a movable manner on a track which runs transverse to the axis of rotation 11 of the drum 12 of the tunnel-type washing machine 10, specifically either independently of one another or together. A track of this type can be formed from parallel rails on which the water-removal presses 18 can move transverse to the passage direction 16 of the tunnel-type washing machine 10. This occurs in such a way that one of the water-removal presses 18 is associated with the discharging chute 19 at the end of the tunnel-type washing machine 10, and therefore one water-removal press 18 can always be loaded by the discharging chute 19 directly with items of laundry containing at least some of the bound liquor, but not the free liquor, arriving from the tunnel-type washing machine 10. The respective water-removal press 18 can be unloaded in a position which differs from the loading position and in which the water-removal press 18 is located next to the discharging chute 19 of the tunnel-type washing machine 10, that is to say not in alignment with said discharging chute—as is the case when loading the water-removal press 18.

As an alternative, it is also feasible to arrange at least one laundry storage means (not shown in the FIGURE) between the tunnel-type washing machine 10 and a single water-removal press 18. A water storage means of this type is preferably designed as a tiltable container which serves to accommodate at least one batch of laundry which has been washed in a washing process in the tunnel-type washing machine 10. The container of the laundry storage means is arranged downstream of the tunnel-type washing machine 10 in such a way that the washed, but not rinsed, items of laundry of at least one batch of laundry can pass directly into the container of the laundry storage means via the discharging chute 19 at the rear end of the tunnel-type washing machine 10. The container of the laundry storage means can tip the items of laundry through the upper opening in the press basket 21 of the water-removal press 18 if said opening has been unblocked for the purpose of receiving the new batch of laundry.

When at least one laundry storage means is present, it is also feasible for the tunnel-time washing machine 10 to have a plurality of associated water-removal presses 18. In this case, the at least one laundry storage means can preferably move along a track which runs transverse to the axis of rotation 11 of the drum 12 of the tunnel-time washing machine 10. A track of this type can also be formed from parallel rails. However, the laundry storage means can also move in a different way, for example on wheels. In the case of movable laundry storage means, the water-removal presses 18 van be arranged in a stationary manner downstream of the tunnel-time washing machine 10, with the at least one laundry storage means being located between the tunnel-time washing machine 10 and the water-removal presses 18. In order to receive washed items of laundry which do not contain the free liquor from the tunnel-time washing machine, the laundry storage means can be moved to a corresponding position relative to the discharging chute 19 of the tunnel-type washing machine, with the result that washed items of laundry can be transferred from the tunnel-type washing machine 10 to the laundry storage means via the discharging chute 19. The laundry storage means is then moved to that water-removal press 18 which is currently free, and the respective batch of laundry is tilted into the relevant water-removal press 18 by the laundry storage means, specifically from above into the press basket 21 of said water-removal press.

The method according to the invention is explained in greater detail below with reference to the apparatus which is shown in the FIGURE:

The items of laundry are only for subjected to prewashing and main washing in the tunnel-type washing machine 10. In the process, the items of laundry are transported through the prewash zone 15 and the main-wash zone 17 of the tunnel-type washing machine 10 in the passage direction 16. Each batch of laundry is initially prewashed in the prewash zone 15 and then subjected to main washing in the main-wash zone 17.

During prewashing of a batch of laundry and during simultaneous main washing of another batch of laundry, the tunnel-type washing machine 10 is driven in rotation in a known manner, specifically either rotating in a circular manner with a plurality of successive compete revolutions of the drum 12 or with a plurality of successive complete revolutions of the drum 12 or with successive partial revolutions in alternating directions of rotation (pivoting drive). If desired, the direction of rotation of the drum 12 of the tunnel-type washing machine 10 can be changed once or more than once during the prewashing operation and also during the main-washing operation by the drum 12 being rotated in a circulating manner in phases with different directions of rotation, but with the drum 12 executing a plurality of complete circuits in each direction. The direction of rotation of the drum is reversed at least once during transfer of the items of laundry from the prewash zone 15 to the main-wash zone 17 and for the simultaneous delivery of the washed items of laundry of a batch of laundry through the end of the main-wash zone 17 of the tunnel-type washing machine 10.

After the respective batch of laundry has then been washed in the main-wash zone 17, it leaves the tunnel-type washing machine 10 without free liquor but with at least some of the bound liquor, preferably all of the bound liquor. The respective batch of laundry with the bound liquor or at least some of said bound liquor is transferred to the at least one downstream water-removal press 18, that is to say the water-removal press 18 is loaded with the washed but not yet rinsed batch of laundry, including the at least majority of bound washing liquid (bound liquor) therein, via the discharging chute 19.

The items of laundry are rinsed in the water-removal press 18 by preferably several successive pressing operations with at least partial removal of water from the items of laundry in each case, initially freed from some of the bound liquor before the items of laundry are rinsed in the water-removal press 18. In order to conclude rinsing, the items of laundry in the water-removal press 18 are freed from a large part of the bound liquor in the usual manner, before the items of laundry which are rinsed in the water-removal press 18 and largely freed from the bound liquor (has water removed) are discharged from the water-removal press 18.

In the water-removal press 18, the items of laundry are initially separated from some of the bound liquor from the tunnel-type washing machine 10 by prepressing. Prepressing is performed by correspondingly deep insertion of the press plunger 22 into the press baskets 28. Prepressing is performed at a pressure of between 2 and 10 bar, preferably approximately at 5 bar. During this prepressing, at least half of the bound liquor is removed from the items of laundry. A large part of the bound liquor is preferably removed from the items of laundry during prepressing, that is to say more than half of the bound liquor. However, prepressing does not only cause some of the bound liquor to be removed from the items of laundry, but rather the batch of laundry in the press basket 21 of the water-removal press 18 is simultaneously precompressed, with the result that the batch of items of laundry contained in the press basket is compressed in the manner of a laundry cake. This laundry cake is substantially impermeable to unpressurized liquid or liquid under only static pressure.

After prepressing, the press plunger 22 in press basket is raised, that is to say the pressure which is exerted on the items of laundry or the laundry cake by the press plunger 22 is again relieved. The press plunger 22 is raised to such an extent liquid can be conducted to the items of laundry, which are compressed to form a laundry cake, through the upper opening in the press basket 21 or through its cylindrical outer wall close to the upper edge. The items of laundry of the laundry cake are rewetted in this way.

According to the invention, so much liquid is supplied to the upper face of the laundry cake in the press basket 21 after prepressing and raising of the press plunger 22 that a closed liquid layer which extends over the entire cross section of the press basket 21 with a specific filling level forms over the laundry cake. This filling level depends on the type and amount of laundry. The filling level preferably corresponds to the height of the laundry cake or is lower. By virtue of the liquid-tight wall of at least that part of the press basket 21 which is filled with liquid, the liquid remains above the laundry cake in the press basket 21, specifically cannot flow away. This is the case because the items of laundry in the laundry cake are pressed against the inner wall of the press basket 21 in a sealing manner during prepressing and in this way seal off the circumferential edge of the laundry cake from the inner face of the wall of the press basket 21.

After a liquid level has been formed over the laundry cake in the press basket 21, this liquid is pressed through the items of laundry in the laundry cake in the press basket 21 under pressure. This is done by lowering the press plunger 22, with said press plunger pushing on the liquid over the laundry cake and building up a pressure in the liquid which leads to the liquid being pushed through the items of laundry in the laundry cake under pressure. This produces effective rinsing of items of laundry. The press plunger 22 is pushed downward in the press basket 21 to such an extent that the liquid, which is now a rinsing liquid, is removed from the items of laundry during rinsing and at the end of the respective rinse process to such an extent that some, preferably a large part, of the bound liquor in the liquid, in particular rinsing liquid, is removed from the items of laundry in order to complete the respective rinse process.

The liquid or rinsing liquid is the pushed through the items of laundry in the laundry cake at a pressure of from 3 to 10 bar, preferably 4 to 6 bar. The items of laundry in the press basket 21 are rinsed and water is subsequently removed from them at this pressure. Moreover, the items of laundry are prepressed to form a laundry cake at a similar pressure. It is feasible to use a lower pressure for prepressing than for pushing the liquid which serves for rinsing purposes through the laundry cake produced during prepressing. This pressure can, for example, be 1.2 to 2 times higher than the pressure used for prepressing.

In order to rinse the laundry, it may be sufficient for liquid which is passed to the laundry cake after prepressing to be pushed through the items of laundry in the laundry cake under pressure only once. In this case, fresh water is used. After prepressing of the items of laundry to form a laundry cake, the press basket 21 of the water-removal press 18 is preferably filled with liquid a number of times and the liquid is then pressed through the items of laundry in the laundry cake under pressure. In this case, fresh water can be used each time. However, it is also feasible to use press water, that is to say free liquor which is captured in the collection tank 20 beneath the press basket 21 and has been removed from the items of laundry during prepressing, for at least a first rinse process. In this case, fresh water is used at least during the last press-through operation of liquid through the laundry cake, it also being possible for the press plunger 22 to then push fresh water through the items of laundry in the laundry cake a number of times.

The fresh water, which serves for rinsing purposes, is then preferably pressed through the items of laundry in the laundry cake at a higher pressure than during prepressing and/or the first rinsing cycles, for which reason only a relatively small part and not necessarily a large part of the bound liquor is removed from the items of laundry. This protects the items of laundry. This has the effect that the items of laundry are freed from a large part of the bound liquor, specifically rinse water, in the water-removal press 18 in order to conclude the rinse process. This rinse water which is produced last and has a relatively small amount of impurities, can be used for initial rinsing of the next batch of laundry in the water-removal press 18. Only then is rinsing performed with fresh water. In this way, the fresh water requirement can also be considerably lowered compared to conventional methods.

In the above-described method, the laundry washed in the tunnel-type washing machine 10 are both rinsed and have water removed from them in the respective water-removal press 18. Rinsing and water-removal therefore do not need to be carried out in the tunnel-type washing machine 10.

| List of reference symbols | |
|---|---|
| 10 | Tunnel-type washing machine |
| 11 | Axis of rotation |
| 12 | Drum |
| 13 | Partition wall |
| 14 | Chamber |
| 15 | Prewash zone |
| 16 | Passage direction |
| 17 | Main-wash zone |
| 18 | Water-removal press |
| 19 | Discharging chute |
| 20 | Collection tank |
| 21 | Press basket |
| 22 | Press plunger |

What is claimed is:

1. A method for the wet-treatment of items of laundry in which the items of laundry are washed in a washing device and water is at least removed in at least one downstream water-removal device, comprising the steps of:

(a) transferring the items of laundry from the washing device, the washing device being a washing machine having a drum (12) that is driven in rotation, to the at least one water-removal device;

(b) rinsing the items of laundry in the at least one water-removal device; and (c) removing water from the items of laundry in the at least one water-removal device, wherein the water-removal device is a water-removal press (18) comprising a press basket (21) and a press plunger (22), and wherein the press plunger (22) is moved downward within the press basket (21) so as to press the items of laundry and remove water from the items of laundry.

2. The method as claimed in claim 1, wherein the items of laundry are substantially only washed in the washing device and the items of laundry are separated from free liquor while still in the washing device.

3. The method as claimed in claim 1, wherein the items of laundry are transferred from the washing device to the at least one water-removal press (18) with only at least some bound liquor from the main washing operation.

4. The method as claimed in claim 1, wherein the items of laundry are separated at least from some bound liquor from the main washing operation while still in the washing device before being rinsed in the water-removal press (18).

5. The method as claimed in claim 1, wherein the items of laundry are transferred from the washing device directly to the water-removal press (18).

6. The method as claimed in claim 1, wherein the items of laundry are at least temporarily stored before being transferred to the water-removal press (18).

7. The method as claimed in claim 1, wherein the washing device is a tunnel-type washing machine (10) with only one prewash zone (15) and a downstream main-wash zone (17).

8. The method as claimed in claim 1, wherein liquid is pressed through the items of laundry a number of times in succession for rinsing purposes in the water-removal press (18).

9. The method as claimed in claim 8, wherein the items of laundry are rinsed by multiple pressing operations in the water-removal press (18), with the last pressing operation being carried out at a higher pressing pressure than the or each preceding pressing operation.

10. The method as claimed in claim 8, wherein the last press-through operation of the liquid through the items of laundry is performed at a higher pressure than the or each preceding press-through operation of the liquid through the items of laundry, with water being removed during the last press-through operation of the liquid through the items of laundry by a large part of bound liquor being pressed out of the items of laundry.

11. The method as claimed in claim 8, wherein the items of laundry are initially prepressed in the respective water-removal press (18), with prepressing of the items of laundry being carried out at a pressure of between 3 and 10 bar.

12. The method according to claim 11, wherein some bound liquor is removed from the items of laundry during the prepressing.

13. The method according to claim 11, wherein after prepressing of the items of laundry, the items of laundry are re-wetted at least once.

14. The method as claimed in claim 11, wherein during the prepressing, a pre-compressed laundry cake is formed from the items of laundry which is substantially impermeable to a pressureless liquid.

15. The method as claimed in claim 14, wherein after the pre-compression, a press plunger (22) of the water-removal press (18) is lifted off the items of laundry or the laundry cake by raising the press plunger (22).

16. The method as claimed in claim 15, wherein liquid is supplied to the items of laundry after the press plunger (22) is raised.

17. The method as claimed in claim 15, wherein a liquid layer is formed on the items of laundry of the laundry cake.

18. The method as claimed in claim 17, wherein the liquid on the items of laundry or the laundry cake is pushed through the items of laundry in the laundry cake under pressure by the press plunger (22).

19. The method as claimed in claim 2, wherein only a prewashing operation and a main washing operation is performed on the items of laundry in the washing device.

20. The method as claimed in claim 19, wherein the items of laundry are separated from some bound liquor while still in the washing device.

21. The method as claimed in claim 11, wherein the prepressing of the items of laundry is carried out at a pressure of between approximately 4 to 6 bar.

22. The method according to claim 12, wherein at least one third of the bound liquor, is removed from the items of laundry during the prepressing.

23. The method as claimed in claim 16, wherein the liquid is fresh water.

24. The method as claimed in claim 17, wherein the liquid layer is a water column.

25. A method for the wet-treatment of items of laundry in which the items of laundry are washed in a washing device and water is at least removed in at least one downstream water-removal device, comprising the steps of:

(a) transferring the items of laundry from the washing device, the washing device being a washing machine having a drum (12) that is driven in rotation, to the at least one water-removal device;

(b) rinsing the items of laundry and removing water from the items of laundry in the at least one water-removal device, wherein the water-removal device is a water-removal press (18) comprising a press basket (21) and a press plunger (22), and wherein the press plunger (22) is moved downward within the press basket (21) so as to press the items of laundry and remove water from the items of laundry; and (c) wherein liquid is pressed through the items of laundry for rinsing purposes in the water-removal press (18).

26. The method as claimed in claim 25, wherein liquid is pressed through the items of laundry a number of times in succession for rinsing purposes in the water-removal press (18).

27. The method as claimed in claim 26, wherein the items of laundry are substantially only washed in the washing device and the items of laundry are separated from free liquor while still in the washing device.

* * * * *